United States Patent [19]

Franke et al.

[11] Patent Number: 4,861,328

[45] Date of Patent: Aug. 29, 1989

[54] MANDREL FOR FORMING A BOTTOM IN A PACKAGING CONTAINER

[75] Inventors: Rickard Franke, Lund; Lars Martensson, Malmö, both of Sweden

[73] Assignee: AB Tetra Pak, Lund, Sweden

[21] Appl. No.: 289,409

[22] Filed: Dec. 21, 1988

Related U.S. Application Data

[63] Continuation of Ser. No. 45,836, May 1, 1987, abandoned.

[30] Foreign Application Priority Data

Jun. 9, 1986 [JP] Japan ..... 61-87742[U]

[51] Int. Cl.[4] ..... B31B 1/28

[52] U.S. Cl. ..... 493/470; 493/183; 493/184; 493/471

[58] Field of Search ..... 493/129, 141, 151, 156, 493/157, 164, 165, 183, 184, 470, 471

[56] References Cited

U.S. PATENT DOCUMENTS 3,196,760 7/1965 Terrg ..... 493/184
3,207,049 9/1965 Monroe et al. ..... 493/141
3,303,761 2/1967 Monroe et al. ..... 493/183
3,405,505 10/1968 Mistarz ..... 493/184
3,408,906 11/1968 Heffelfinger et al. ..... 493/183

*Primary Examiner*—Frederick R. Schmidt
*Assistant Examiner*—Robert Showalter
*Attorney, Agent, or Firm*—Koda and Androlia

[57] ABSTRACT

A mandrel used in a packaging machine being in a tubular shape and provided with a cooling chamber at one end so as to cool a plain plate which is positioned at the top of the mandrel and contacts the heated, infolded and compressed bottom of a tubular package carton blank. Four projections are formed on the outer surface of the mandrel so as to contact each corner of the tubular package carton blank to leave it open. A pair of water cooling pipes are provided in the tubular mandrel with a space left between the internal wall of the tubular mandrel and connected to the cooling chamber so that only the bottom of the heat-sealed container made of a tubular package carton blank with thermoplastic coatings thereon is cooled and the side walls of the container are free from moisture condensation.

1 Claim, 4 Drawing Sheets

MANDREL FOR FORMING A BOTTOM IN A PACKAGING CONTAINER

This is a continuation of application Ser. No. 045,836, filed May 1, 1987, now abandoned.

BACKGROUND OF THE INVENTION

1. Field of the Invention

The present invention relates to a mandrel disposed on a packaging machine to form the bottom of a packaging container by folding and sealing a tubular package carton blank which is a thermoplastic coated paperboard and is provided with folding lines at both ends thereof.

2. Prior Art

Most beverages such as milk, juice, or the like are marketed in disposable packaging containers made of paperboard coated with a thin layer of plastic coating.

A beverage container having a gable top is formed from a tubular, half-completed carton blank which is generally square in cross section (see FIG. 5). The tubular carton blank includes four rectangular panels forming upstanding side walls divided by folding lines and two other portions which respectively form the top and bottom of the container. The top and bottom plates are folded about folding lines provided thereon to form respectively a gable top and a flat bottom.

The aforesaid tubular carton blank is folded into a tubular body configuration from a flat folded form. The carton blank is placed over a mandrel so that a foldable portion of the bottom of the tubular container is extruded from the top end of the mandrel. The mandrels are disposed radially on a mandrel wheel which rotates intermittently in a packaging container bottom forming apparatus. Then, the mandrel wheel rotates and pauses at the next step where heat is applied by hot air to soften and activate the thermoplastic coating on the foldable portion of the bottom of the paperboard container for heat-sealing. During the next movement of intermittent rotation, the foldable portion of the bottom is folded about the folding lines by means of a pair of folding devices. The folding devices each have two projecting folding fingers which are disposed on opposite sides of the circumferential route of the circular movement of the foldable portion of the bottom of the container. Then, the folded bottom is transferred through guides to the following step for sealing. At the sealing step, the bottom of the paperboard container which has been folded and prepared for sealing is compressed and sealed by heat-sealing between a flat top plate on the top of the mandrel and presser to form a sealed bottom. After the bottom is sealed, the completed container is transported to a removal station via an intermediate station wherein the bottom is cooled down to complete the sealing process before the container is removed from the removal step onto a conveyor line (See FIG. 4). Consequently, the half-finished tubular container, after being placed on the conveyor line, is filled with a beverage before the next step of folding and sealing the top portion thereof via heat sealing so as to provide a gable top.

The top of the mandrel is cooled with water so as to prevent the plastic coating on the body of the paperboard container from sticking due to the heat and pressure applied to the flat top plate disposed on top of the mandrel, while the heated and folded bottom is compressed between the outer end of the mandrel and the presser.

As shown in FIG. 7, the prior art mandrel has a cooling chamber 4′ on the outer end of a mandrel body 2′. The cooling chamber 4′ communicates with a flat top plate 3′ so as to cool down the flat top plate 3′ disposed above the top end of the mandrel 1′. As best seen in FIG. 9, which is a cross sectional view of the mandrel body taken along the line 9—9 of FIG. 7, the body of the mandrel 2′ is H-shaped in cross section with the central member 2*b*′ being of a certain thickness between a pair of crescent shaped side members 2*a*′. The end portions 5′ of the mandrel fit inside the corners of the adjacent side panels C1 and C2 of the body of the tubular container C to correspond with the square configuration of the cross section of the body of the container. A pair of water-ways 6′ are formed lengthwise in the central member 2*b*′ and open to the aforesaid cooling chamber 4′. Cooling water flows from one of the waterways to the other via the cooling chamber 4′. Either the flat top plate 3′ on top of the mandrel or the periphery of the cooling chamber 4′ is formed to fit the inner wall of the tubular container C (see FIG. 8). The aforesaid cross sectional configuration of the mandrel is provided from the top end of the mandrel to the central area thereof to accept the tubular container C in full length thereon. In addition, the central member 2*b*′ of the mandrel is provided with through holes 2*c*′ for installing a stopper relative to the length of the tubular container employed.

As mentioned above, in the prior art the mandrel has waterways 6′ provided in the mandrel body 2′, so that cooling water flows through the cooling chamber 4′ to cool down the bottom of the container which is sealed by heat-sealing. Accordingly, during the heat-sealing operation in which the folded bottom of the packaging container C is compressed and sealed between the flat top plate 3′ on top of the mandrel and a pressing member 9 of the presser a pair of opposing side panels C1 and C1, and C2 and C2 of the tubular container C are directly cooled down by the crescent shaped side members 2*a*′ of the mandrel body 2′ which have been cooled by the cooling water and respectively fitted inside the corners formed by the adjacent side panels C1 and C2. Thus, moisture condensation occurs on the inner surfaces of the side panels C1 and C2. As a result, sanitary problems are created, for example impurities in the air are likely to be extracted from the water drops and remain on the inner surfaces of the aforesaid side panels. In addition, the mandrel 1′ of the prior art is designed to be H-shaped in cross section and has recesses including through holes for installing a stopper and thus, cleaning is not facilitated.

SUMMARY OF THE INVENTION

In view of the prior art, the present invention is directed toward a mandrel for forming a bottom of a packaging container wherein cooling is effected to only a flat top plate on the top of the mandrel to be cooled and not to any other part of the mandrel body. Therefore, moisture condensation inside of the tubular container is eliminated, avoiding possible sanitary problems and construction of the mandrel is simplified to facilitate cleaning after use.

The device of the present invention is directed toward a mandrel mounted on a beverage packaging machine. The mandrel is formed in a tubular configuration and provided with a cooling chamber on the outer end thereof so as to cool down a flat top plate disposed above the top of the mandrel. The flat top plate comes into direct contact with the heated, infolded and compressed bottom of a tubular packaging container, wherein four fins formed on the outer surface of the mandrel body are arranged radially so as to fit respectively inside the corners formed by the adjacent side panels of a rectangular tubular package container. A pair of waterways for supplying and discharging cooling water are connected to the cooling chamber and arranged in the tubular mandrel. The waterways are provided apart from the inner surface of the tubular mandrel.

The mandrel of the present invention includes cooling waterways for circulating cooling water through the cooling chamber arranged apart from the inner surface of the tubular mandrel so that the side wall of the mandrel is not cooled. The mandrel also has four fins which are formed on the tubular mandrel so as to fit respectively inside the corners of the tubular packaging container. The cooling waterways are provided to cool the flat top plate on top of the mandrel using cooling water circulating through the cooling chamber so that the thermoplastic coating on a paperboard blank forming the bottom of the package container is prevented from sticking to the aforesaid flat top plate during the heat-sealing operation in which the tubular package container is placed on the mandrel to seal the bottom of the container. Accordingly, in the heat-sealing process for forming the bottom of the packaging container, the inner wall of the container will not be cooled down and thus will be free from moisture condensation, which hence, eliminates sanitary problems so that the container can be transferred to the next process of filling the container with a food product. In addition, the mandrel has a simple peripheral configuration so as to facilitate after-operation cleaning.

DETAILED DESCRIPTION OF THE INVENTION

Figure 1:
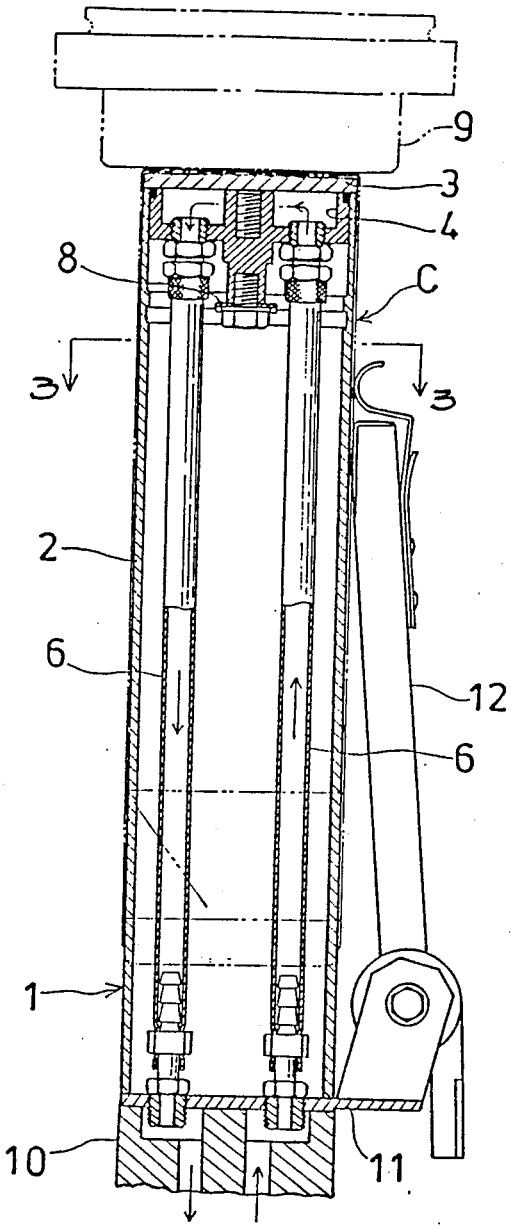
FIG. 1 is a central vertical sectional view of a mandrel according to the present invention.
Figure 2:
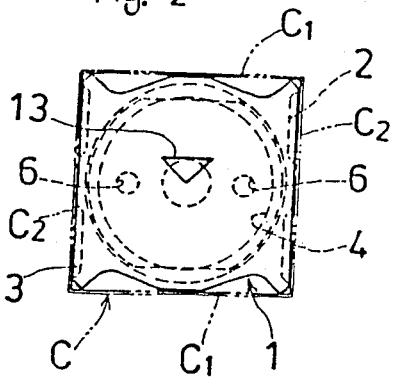
FIG. 2 is a plan view of the flat top plate disposed on top of the mandrel.
Figure 3:
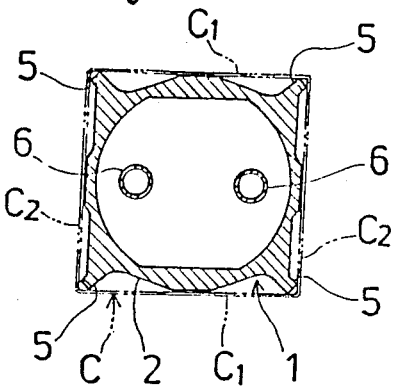
FIG. 3 is a sectional view taken along the line 3—3 of FIG. 2.

One preferred embodiment of the present invention is described hereinafter in conjunction with the accompanying drawings.

The mandrel 1 includes a tubular mandrel body 2 made of metal, a flat top plate 3 disposed substantially on top of the mandrel body 2 to directly accept the infolded bottom of a tubular package container C thereon, and a cooling chamber 4. The cooling chamber 4 is of a predesignated size and is formed on the back of the flat top plate 3. The cooling chamber 4 communicates with the flat top plate 3 by means of a screw at the center and is secured with a screw to a spring plate 8 accepted on a recess formed in an inner member of the mandrel body 2.

The mandrel body 2 is secured to a base plate 11 with screws screwed in a thick wall portion of the mandrel side wall thereof (not shown). The base plates 11, each having a pressing arm 12 pressing against one side of the side of the mandrel for holding the container, are secured respectively to five flat surfaces arranged on the side wall of a mandrel wheel 10.

A pair of spaced parallel waterways 6 for cooling water are provided within the tubular mandrel body 2 with a space left from the inner wall of the mandrel body 2 and each waterway is secured with both ends thereof screw-tightened respectively to the base plate 11 and the bottom of the cooling chamber 4.

Cooling water is supplied from a cooling water inlet provided inside the mandrel wheel 10 via one of the cooling waterways 6 through the cooling chamber 4 and then, to return via another waterway 6 to a cooling water outlet provided inside the mandrel.

Four fins 5 are formed outwardly in radial relation on the outer wall of the mandrel body 2 throughout its lengths so as to fit respectively inside the corners formed by the adjacent panels C1 and C2 of the tubular package container C when it is put on the mandrel. In addition, between the fins 5 the side walls of the mandrel body 2 have portions which outwardly project and make tight contact with the inner wall of the tubular package container to securely hold the container. A small triangle-shaped area in relief 13 formed outwardly on the flat top plate 3 is provided to receive the center portion of the infolded and overlapped bottom surface of the container body.

Figure 5:
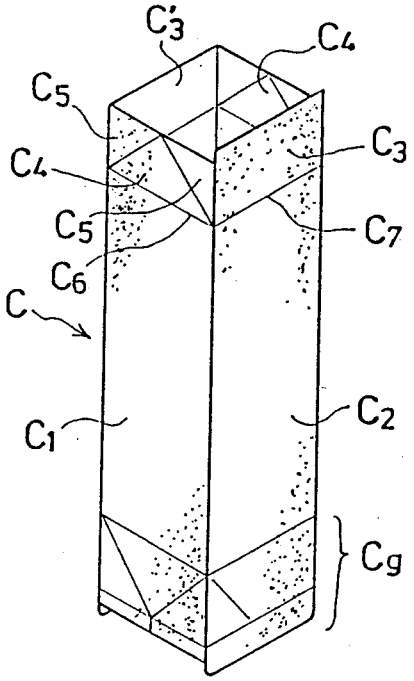
FIG. 5 is a perspective view of a package container which is built with the mandrel of the present invention.

FIG. 5 is a perspective view of the tubular package container C to be completed using the mandrels of the present invention. The container C is shown upside-down in FIG. 5 wherein a foldable bottom portion thereof is positioned above the foldable top portion Cg of the container which will be folded into a gable-like configuration (not shown). The tubular package container C is formed by folding it at the folding lines into a tubular configuration from a multi-layer sheet blank which contains substantially a supporting paper layer coated uniformly with thermoplsatic coatings on both sides. The package container C is square in cross section and has four sides, a pair of oppositely facing panels C1 and C1, and C2 and C2, a pair of foldable rectangular flaps C3 and C3′ so that it is folded about the folding lines C6 to C7 to form the bottom of the container.

Figure 6:
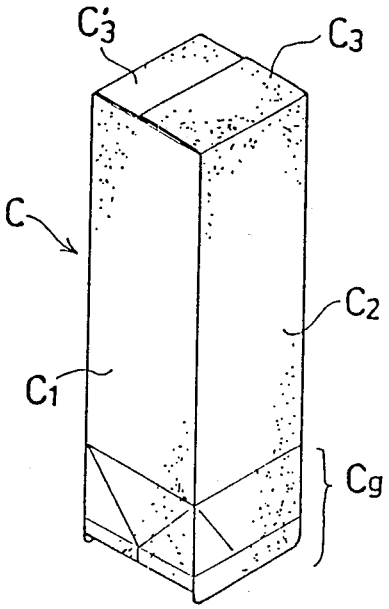
FIG. 6 is a perspective view of a package container with its bottom folded and sealed.
Figure 7:
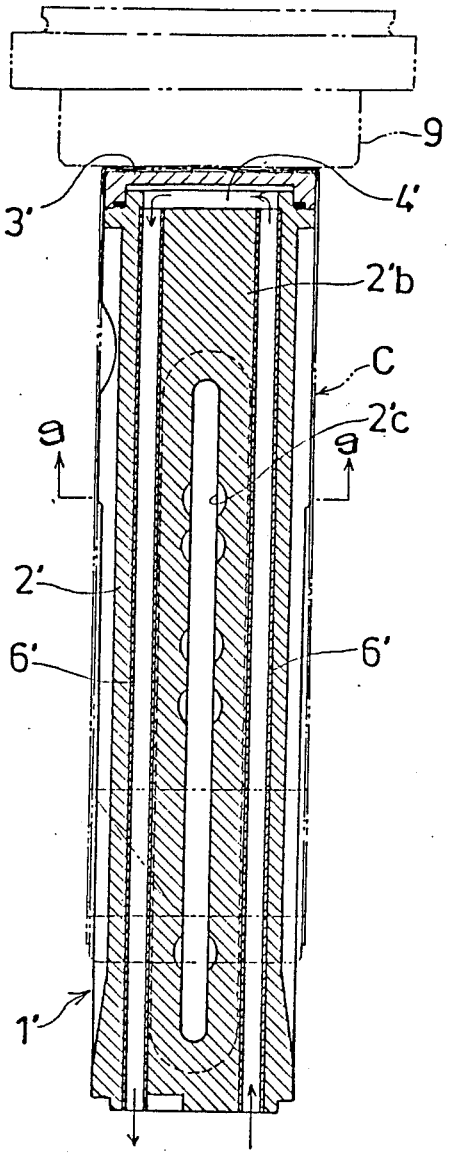
Fig. 7 Prior Art
FIG. 7 is a central vertical sectional view of the mandrel disclosed in the prior art.
Figure 8:
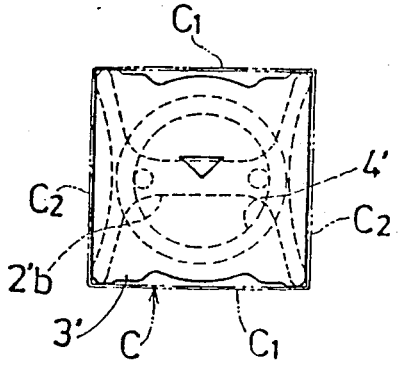
Fig. 8 Prior Art
FIG. 8 is a plan view of a flat top plate disposed on top of the mandrel shown in FIG. 7.
Figure 9:
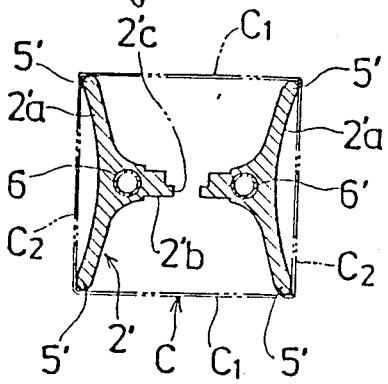
Fig. 9 Prior Art
FIG. 9 is a sectional view taken along line 9—FIG. 7.

In particular, the facing triangle-shaped bottom side portions C4 and small triangle-shaped infolding portions C5 adjacent the side portion C4 are folded from the bottom thereof as best seen in FIG. 6 during the folding operation wherein, while the package container C mounted on one of the mandrels is being transferred intermittently, the side portions C4 and the rectangular bottom flap C′3 are folded consecutively by a folding device 15 (which will be described later). Then, the rectangular flap C3 is a little larger in length than the aforesaid opposite flap C′3 is folded over the edge of the flap C′3 for sealing.

Next, the relationship between the package container C and the mandrel 2 wherein the mandrel 2 receives the tubular package container body C thereon will be described.

Figure 4:
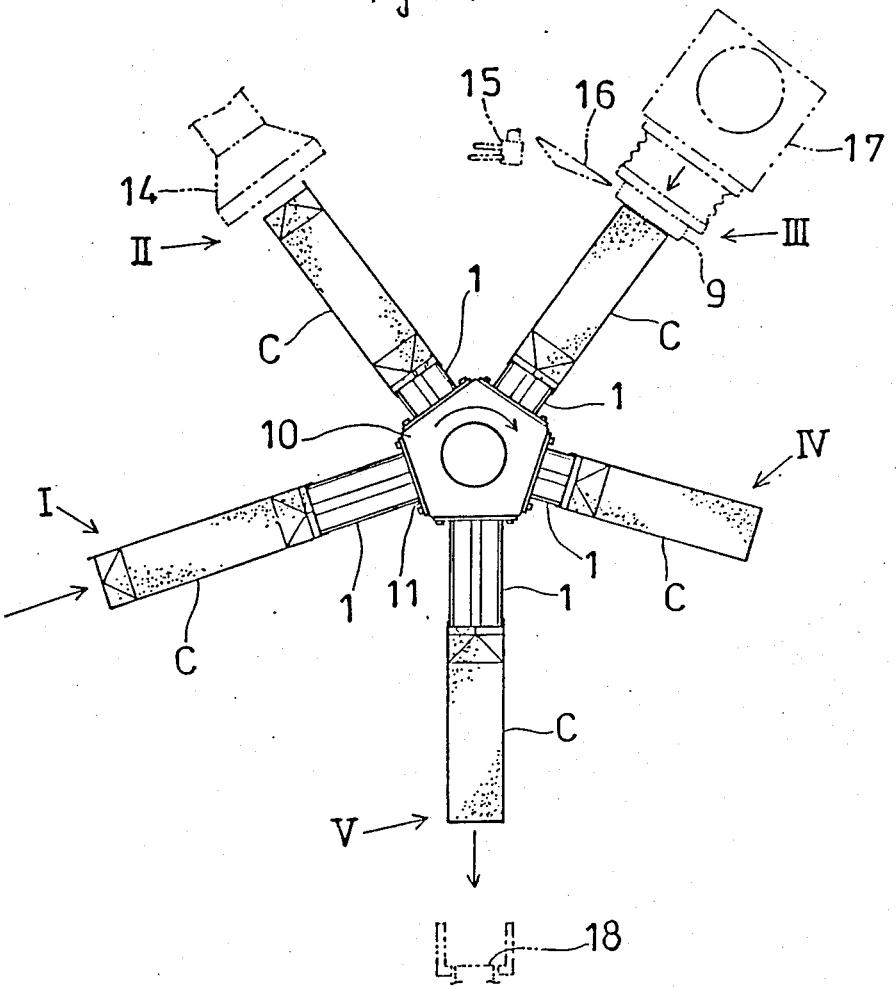
FIG. 4 is a side view of a package container bottom forming apparatus provided with the mandrel of the present invention.

FIG. 4 is a rough illustration of a side view of the apparatus used in assembling the bottom of a package container provided with the mandrels 1 of the present invention. The mandrels 1 are arranged in radial relationship. Each mandrel 1 is mounted through the base plate 11 on one of the five uniformly spaced plane surfaces of the mandrel wheel 10 which are formed on the side wall of the mandrel wheel 10 which is equally divided into five spaces. The mandrel wheel 10 is provided with an inner water channel arrangement to supply and discharge cooling water through each of the mandrels 1. The mandrel wheel 10 rotates intermittently (clockwise in FIG. 4) pausing at intervals of 1/5 rotation. Operation means relative to the working steps are consequetively arranged on the outside of and along the circumferential route of the circular movement of the mandrel 1 disposed on the mandrel wheel 10 which rotates intermittently.

In the feeding step I, the tubular package container C is placed on the mandrel 1 using a feeding arrangement (not shown) so that the fold lines C6 and C7 on the bottom portion thereof (see FIG. 5) are nearly level with the flat top plate 3. The container C placed at the right position is kept held by the pressing arm 12 (FIG. 1) and thereafter, is transferred to the next step II for heat treatment via movement of 1/5 rotation of the mandrel wheel 10 so that the infolded bottom of the package container C placed outwardly on the top end of the mandrel faces a hot air nozzle 14. The hot air nozzle 14 communicates with a fan (not shown) and an air heating device (not shown) provides hot air to heat up the foldable bottom portions C3 and C'3, and C4 and C5 of the package container C which are to be heat-sealed so that the thermoplastic coating thereon melts to seal off. The bottom portions of the package container C, after being heated up to a proper temperature, will be folded by means of a pair of folding arrangement 15, each having two projecting folding fingers, which are disposed oppositely on both sides of the aforesaid circumferential route thereof, during further movement of 1/5 rotation of the mandrel wheel 10.

Then, the bottom flap C3 of the package container C will be folded in position by pressing and guiding it so that the bottom of the container is transferred to the front of a compressing device 17 at the next step III while the thermoplastic coating thereon is still softened. During a pause in the movement of the mandrel wheel 10, the aforesaid infolded bottom portions of the package container C will be compressed and sealed by pressing them with a pressing member 9 of the pressing device 17 moved downwardly. At this time, the flat top plate 3 on the mandrel 1 is kept cool by providing the cooling chamber 4 with cooling water. Thus, the thermoplastic coating on the bottom surface of the package is protected from sticking to the flat top plate 3 of the mandrel 1 during the compressing and sealing operations performed between the pressing member 9 and the mandrel 1.

The package container C with its bottom sealed is then transferred, via another step IV having no means for working, during the movement of 1/5 of the mandrel wheel 10 to a removal step V where the package container is loaded onto a conveyor 18 by a releasing and removing device which is not shown. Finally, the package container C, while being transferred by the conveyor 18, will be filled with a product (beverage) and sealed off completely by forming a gable top thereon.

During the aforesaid sealing operation for the bottom of the package container C, the side wall of the mandrel body is not cooled down as set forth above, although the aforesaid flat top plate 3 on the top of the mandrel 1 is kept cool constantly by providing the cooling chamber 4 with cooling water, so that moist condensation resulting from variations in temperature is eliminated.

It is apparent from the foregoing detailed description that the mandrel for forming the bottom of a package container disclosed by the present invention can prevent moist condensation from being produced on the inner wall of the container, whereby the possibility of sanitary problems caused thereby can be avoided. In addition, the mandrel of the present invention has a simplified periphery construction to facilitate cleaning thereof and thus, improve work efficieny.

We claim:

1. A mandrel mounted on a packaging machine on which the bottom of a tubular package carton blank provided with thermo-plastic coatings and folding lines thereon is folded to be heat-sealed after said blank is inserted on said mandrel, wherein the body of said mandrel is formed in a tubular shape and provided with a cooling chamber at one end of the body of said mandrel so as to cool a plane plate, which is the top of said mandrel and contacts the heated, infolded and compressed bottom of said tubular package carton blank, four fins formed on the outer surface of the body of said mandrel respectively projecting outwardly so as to contact the inside corners of said tubular package carton blank, side walls of the body of the mandrel between said fins outwardly project and make tight contact with inner walls of the tubular package carton blank to securely hold the tubular package carton blank and a pair of pipes for injecting and discharging cooling water being connected to said cooling chamber and arranged inside the body of said tubular mandrel with a space between the inner wall of the body of said tubular mandrel, said pair of cooling pipes further being provided at the center of said tubular mandrel and apart from the inner surface of said mandrel.

* * * * *